US007284612B2

(12) United States Patent
Ratanasirigulchai et al.

(10) Patent No.: US 7,284,612 B2
(45) Date of Patent: Oct. 23, 2007

(54) CONTROLLING TRANSIENT PRESSURE CONDITIONS IN A WELLBORE

(75) Inventors: Wanchai Ratanasirigulchai, Shanghai (CN); Lawrence A. Behrmann, Houston, TX (US); Andrew J. Martin, Aberdeen (GB); Kenneth R. Goodman, Cypress, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 267 days.

(21) Appl. No.: 10/710,564

(22) Filed: Jul. 21, 2004

(65) Prior Publication Data

US 2004/0231840 A1 Nov. 25, 2004

Related U.S. Application Data

(63) Continuation-in-part of application No. 10/667,011, filed on Sep. 19, 2003, now Pat. No. 7,182,138, which is a continuation-in-part of application No. 10/316,614, filed on Dec. 11, 2002, now Pat. No. 6,732,798, which is a continuation-in-part of application No. 09/797,209, filed on Mar. 1, 2001, now Pat. No. 6,598,682.

(60) Provisional application No. 60/252,754, filed on Nov. 22, 2000, provisional application No. 60/187,900, filed on Mar. 8, 2000, provisional application No. 60/186,500, filed on Mar. 2, 2000.

(51) Int. Cl.
*E21B 43/117* (2006.01)

(52) U.S. Cl. ..... 166/297; 166/311; 175/4.54

(58) Field of Classification Search ..... 166/311, 166/297, 55.1, 63, 163, 164, 169, 177.5, 166/177.7; 175/4.54, 4.6
See application file for complete search history.

(56) References Cited

U.S. PATENT DOCUMENTS

| | | | |
|---|---|---|---|
| 3,528,511 | A | 9/1970 | Boop |
| 3,760,878 | A | 9/1973 | Peevey |
| 4,175,042 | A | 11/1979 | Mondshine |
| 4,253,523 | A | 3/1981 | Ibsen |

(Continued)

FOREIGN PATENT DOCUMENTS

| | | | |
|---|---|---|---|
| EP | 0615053 | A | 4/1994 |

(Continued)

OTHER PUBLICATIONS

Behrmann, Lawrence A. and McDonald, Bryan; "Underbalance or Extreme Overbalance"; SPE Production & Facilities, vol. 14, No. 3, Aug. 1999, pp. 187-196.

(Continued)

*Primary Examiner*—Hoang Dang
(74) *Attorney, Agent, or Firm*—Dan C. Hu; Kevin B. McGoff; Bryan P. Galloway

(57) ABSTRACT

A method and apparatus for use in a wellbore includes running a tool string to an interval of the wellbore, and activating a first component in the tool string to create a transient underbalance pressure condition in the wellbore interval. Additionally, a second component in the tool string is activated to create a transient overbalance pressure condition in the wellbore interval, or vice versa.

12 Claims, 5 Drawing Sheets

U.S. PATENT DOCUMENTS

| | | | | |
|---|---|---|---|---|
| 4,372,384 | A | 2/1983 | Kinney | |
| 4,391,337 | A | 7/1983 | Ford | |
| 4,484,632 | A | 11/1984 | Vann | |
| 4,515,217 | A * | 5/1985 | Stout | 166/297 |
| 4,576,233 | A | 3/1986 | George | |
| 4,619,325 | A | 10/1986 | Zunkel | |
| 4,621,692 | A | 11/1986 | Mondshine | |
| 4,650,010 | A | 3/1987 | George et al. | |
| 4,804,044 | A | 2/1989 | Wesson et al. | |
| 4,805,726 | A | 2/1989 | Taylor et al. | |
| 5,088,557 | A * | 2/1992 | Ricles et al. | 166/297 |
| 5,103,912 | A | 4/1992 | Flint | |
| 5,131,472 | A | 7/1992 | Dees et al. | |
| 5,135,051 | A | 8/1992 | Facteau et al. | |
| 5,228,508 | A | 7/1993 | Facteau et al. | |
| 5,295,545 | A | 3/1994 | Passamaneck | |
| 5,318,126 | A | 6/1994 | Edwards et al. | |
| 5,355,802 | A | 10/1994 | Petitjean | |
| 5,635,636 | A | 6/1997 | Alexander | |
| 6,062,310 | A * | 5/2000 | Wesson et al. | 166/297 |
| 6,082,450 | A | 7/2000 | Snider | |
| 6,098,707 | A | 8/2000 | Pastusek | |
| 6,158,511 | A * | 12/2000 | Wesson | 166/308.1 |
| 6,173,783 | B1 | 1/2001 | Abbott-Brown et al. | |
| 6,206,100 | B1 | 3/2001 | George et al. | |
| 6,220,355 | B1 | 4/2001 | French | |
| 6,336,506 | B2 | 1/2002 | Wesson | |
| 6,527,050 | B1 * | 3/2003 | Sask | 166/299 |
| 2005/0045334 | A1 * | 3/2005 | Hayes | 166/305.1 |

FOREIGN PATENT DOCUMENTS

| | | | |
|---|---|---|---|
| GB | 617817 | | 2/1949 |
| GB | 2379687 | A | 3/2003 |
| GB | 2396175 | A | 6/2004 |
| GB | 2406114 | A | 3/2005 |
| RU | 1771508 | A3 | 10/1992 |
| RU | 2131512 | C1 | 6/1999 |
| RU | 2162514 | C1 | 1/2001 |
| RU | 2211313 | C1 | 8/2003 |
| WO | WO 99/42696 | | 8/1999 |
| WO | 00/01924 | A1 | 1/2000 |
| WO | WO 01/25595 | A1 | 4/2001 |

OTHER PUBLICATIONS

Chang, F.F., Ali, S.A., Cromb, J., Bowman, M., and Partar, P., "Development of a New Crosslinked-HEC Fluid Loss Control Pill for Highly-Overbalanced, High-Permeability and/or High Temperature Formations," SPE 39438, presented at the International Symposium on Formation Damage Control, Lafayette, Louisiana, Feb. 18-19, 1998.

Folse, K., Allin, M., Chow, C., and Hardesty, J., "Perforating System Selection for Optimum Well Inflow Performance," SPE 73762 presented at the Internal Symposium on Formation Damage, Lafayette, LA, Feb. 20-21, 2002.

Johnson, A.B., Walton, I.C., and Atwood, D.C.; "Wellbore Dynamics While Perforating and Formation Interaction," SLB Internal Report PFD01-03.

Scott, Wu and Bridges, "Air Foam Improves Efficiency of Completion and Workover Operations in Low-Pressure Gas Wells", SPE 27922, Dec. 1995, pp. 219-225.

Walton, I.C., Johnson, A.B., Behrmann, L.A., and Atwood, D.C., "Laboratory Experiments Provide New Insights into Underbalanced Perforating", SPE 71642 presented at the Annual Technical Conference, New Orleans, LA, Sep. 30-Oct. 3, 2001.

Overview of Implo Treat pamphlet, Implo Treat Systems, Jan. 17, 2000, 4 pgs.

* cited by examiner

CONTROLLING TRANSIENT PRESSURE CONDITIONS IN A WELLBORE

CROSS REFERENCE TO RELATED APPLICATIONS

This is a continuation-in-part of U.S. Ser. No. 10/667,011, filed Sep. 19, 2003 now U.S. Pat. No. 7,182,138, which is a continuation-in-part of U.S. Ser. No. 10/316,614, filed Dec. 11, 2002, now U.S. Pat. No. 6,732,798, which is a continuation-in-part of U.S. Ser. No. 09/797,209, filed Mar. 1, 2001, now U.S. Pat. No. 6,598,682, which claims the benefit of U.S. Provisional Application Ser. Nos. 60/186,500, filed Mar. 2, 2000; 60/187,900, filed Mar. 8, 2000; and 60/252,754, filed Nov. 22, 2000. Each of the referenced applications is hereby incorporated by reference.

BACKGROUND OF INVENTION

The invention relates to improving reservoir communication within a wellbore.

To complete a well, one or more formation zones adjacent a wellbore are perforated to allow fluid from the formation zones to flow into the well for production to the surface or to allow injection fluids to be applied into the formation zones. A perforating gun string may be lowered into the well and the guns fired to create openings in casing and to extend perforations into the surrounding formation.

The explosive nature of the formation of perforation tunnels shatters sand grains of the formation. A layer of "shock damaged region" having a permeability lower than that of the virgin formation matrix may be formed around each perforation tunnel. The process may also generate a tunnel full of rock debris mixed in with the perforator charge debris. The extent of the damage, and the amount of loose debris in the tunnel, may be dictated by a variety of factors including formation properties, explosive charge properties, pressure conditions, fluid properties, and so forth. The shock damaged region and loose debris in the perforation tunnels may impair the productivity of production wells or the injectivity of injector wells.

One popular method of obtaining clean perforations is underbalanced perforating. The perforation is carried out with a lower wellbore pressure than the formation pressure. The pressure equalization is achieved by fluid flow from the formation and into the wellbore. This fluid flow carries some of the damaging rock particles. However, underbalance perforating may not always be effective and may be expensive and unsafe to implement in certain downhole conditions.

Fracturing of the formation to bypass the damaged and plugged perforation may be another option. However, fracturing is a relatively expensive operation. Moreover, clean, undamaged perforations are required for low fracture initiation pressure (one of the pre-conditions for a good fracturing job). Acidizing, another widely used method for removing perforation damage, is less effective in removing the perforation damage, or for treating sand and loose debris left inside the perforation tunnel. Additionally, having undamaged perforations implies a better matrix or acid fracture job in a carbonate formation.

A need thus continues to exist for a method and apparatus to improve fluid communication with reservoirs in formations of a well.

SUMMARY OF INVENTION

In general, a method and apparatus for use in a wellbore includes running a tool string to an interval of the wellbore, and activating a first component in the tool string to create a transient underbalance pressure condition in the wellbore interval. A second component in the tool string is activated to create a transient overbalance pressure condition in the wellbore interval.

In general, according to another embodiment, a method and apparatus for use in a wellbore includes running a tool string to an interval of the wellbore, and activating a first component in the tool string to create a transient overbalance pressure condition in the wellbore interval. A second component in the tool string is activated to create a transient underbalance pressure condition in the wellbore interval.

Other or alternative features will become apparent from the following description, from the drawings, and from the claims.

DETAILED DESCRIPTION

Figure 1:
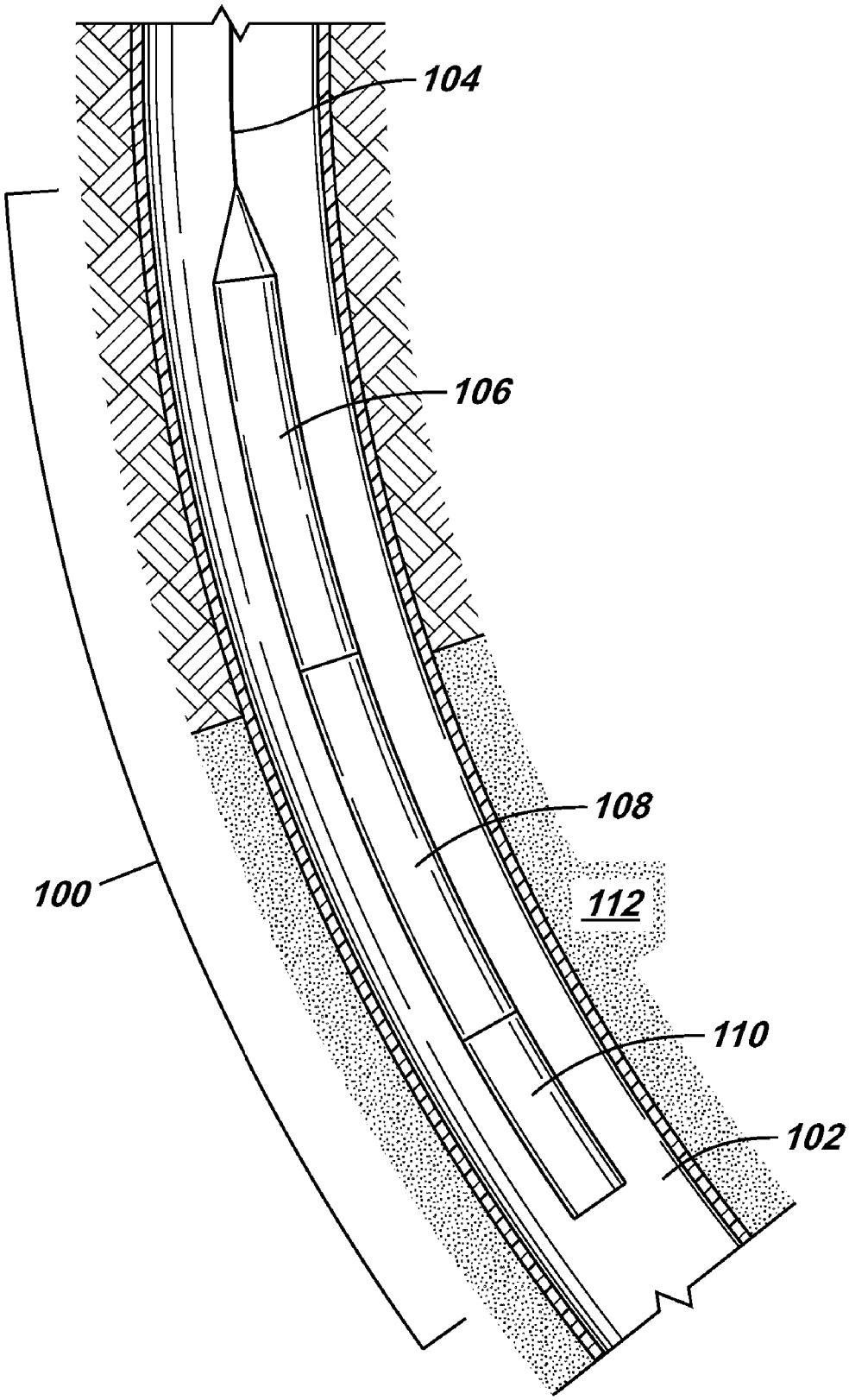
FIG. 1 illustrates a tool string for applying transient underbalance and/or overbalance pressure conditions in a wellbore interval, according to some embodiments.

In the following description, numerous details are set forth to provide an understanding of the present invention. However, it will be understood by those skilled in the art that the present invention may be practiced without these details and that numerous variations or modifications from the described embodiments may be possible.

As used here, the terms "up" and "down"; "upper" and "lower"; "upwardly" and "downwardly"; "upstream" and "downstream"; "above" and "below" and other like terms indicating relative positions above or below a given point or element are used in this description to more clearly described some embodiments of the invention. However, when applied to equipment and methods for use in wells that are deviated or horizontal, such terms may refer to a left to right, right to left, or other relationship as appropriate.

According to some embodiments of the invention, transient overbalance and underbalance pressure conditions are generated in a wellbore to enhance communication of formation fluids with the wellbore. The well operator is able to control a sequence of underbalance and overbalance conditions to perform desired cleaning and/or stimulating tasks in one or plural wellbore intervals in a well.

There are several potential mechanisms of damage to formation productivity and injectivity due to perforation. One may be the presence of a layer of low permeability sand grains (grains that are fractured by explosive shaped charge) after perforation. As the produced fluid from the formation may have to pass through this lower permeability zone, a higher than expected pressure drop may occur resulting in lower productivity. The second major type of damage may arise from loose perforation-generated rock and charge debris that fills the perforation tunnels. Debris in perforation tunnels may cause declines in productivity and injectivity (for example, during gravel packing, injection, and so forth). Yet another type of damage occurs from partial opening of perforations. Dissimilar grain size distribution can cause some of these perforations to be plugged (due to bridging, at the casing/cement portion of the perforation tunnel), which may lead to loss of productivity and infectivity.

To address these issues, pressure in a wellbore interval is manipulated in relation to the reservoir pressure to achieve removal of debris from perforation tunnels. The pressure manipulation includes creating a transient underbalance condition (the wellbore pressure being lower than a formation pressure) or creating an overbalance pressure condition (when the wellbore pressure is higher than the reservoir pressure) prior to detonation of shaped charges of a perforating gun or a propellant. Creation of an underbalance condition can be accomplished in a number of different ways, such as by use of a low pressure chamber that is opened to create the transient underbalance condition, the use of empty space in a perforating gun to draw pressure into the gun right after firing of shaped charges, and other techniques (discussed further below).

Creation of an overbalance condition can be accomplished by use of a propellant (which when activated causes high pressure gas buildup), a pressurized chamber, or other techniques.

The manipulation of wellbore pressure conditions causes at least one of the following to be performed: (1) enhance transport of debris (such as sand, rock particles, etc.) from perforation tunnels; (2) achieve near-wellbore stimulation; and (3) perform fracturing of surrounding formation.

In accordance with some embodiments of the invention, the sequence of generating underbalance and overbalance pressure conditions is controllable by a well operator. For example, the well operator may cause the creation of a transient underbalance, followed by a transient overbalance condition. Alternatively, the well operator may start with a transient overbalance condition, followed by a transient underbalance condition. In yet another scenario, the well operator can create a first transient underbalance condition, followed by a larger transient underbalance condition, followed by a transient overbalance condition, and so forth. Any sequence of transient underbalance and overbalance pressure conditions can be set by the user, in accordance with the needs of the well operator.

FIG. 1 illustrates a tool string 100 that has been lowered into an interval of a wellbore 102. The tool string 100 is carried into the wellbore 102 by a carrier structure 104, such as a wireline, slickline, coiled tubing, or other carrier structure. The tool string 100 includes several components, including a first component 106 (referred to as an "underbalance pressure creating component") for generating a transient underbalance pressure condition in the wellbore 102, a second component 108 (referred to as an "overbalance pressure creating component") to generate a transient overbalance pressure condition, and a perforating gun 110 for creating perforations into surrounding formation 112. Note that the perforating gun 110 can be combined with either of the underbalance pressure creating component 106 or the overbalance pressure creating component 108. In other implementations, the perforating gun 110 can be omitted or replaced with another tool.

The first component 106 can be activated first to create the underbalance pressure condition, followed by activating the second component 108 to create the overbalance pressure condition. In some scenarios, the second component 108 can be activated while the underbalance pressure condition is still present. Conversely, the second component 108 can be activated first to create the overbalance pressure condition, followed by activating the first component 106 to create the underbalance pressure condition. In some scenarios, the first component 106 can be activated while the overbalance pressure condition is still present.

As used here, a "component" can refer to either a single module or an assembly of modules. Thus, for example, an underbalance pressure creating component can include a low pressure module (such as an empty chamber), a second module containing explosive devices, and other modules (such as connector modules to connect to other parts of a tool string). The modules may be separate items or integrated into a single tool.

To create an underbalance pressure condition in the wellbore interval, the well operator provides a control signal (which can be an electrical signal, optical signal, pressure pulse signal, mechanical signal, hydraulic signal, and so forth) to cause activation of the underbalance pressure creating component 106. Once the underbalance condition is created in the wellbore interval, a downhole task (such as a perforating task) is performed. Next, the well operator may cause the overbalance pressure creating component 108 to generate an overbalance condition in the wellbore interval. The overbalance condition may cause creation of a sufficient pressure to cause fracturing or other stimulation of the surrounding formation (such as after perforation tunnels have been extended by the perforating gun 110 into the formation 112).

Figure 2:
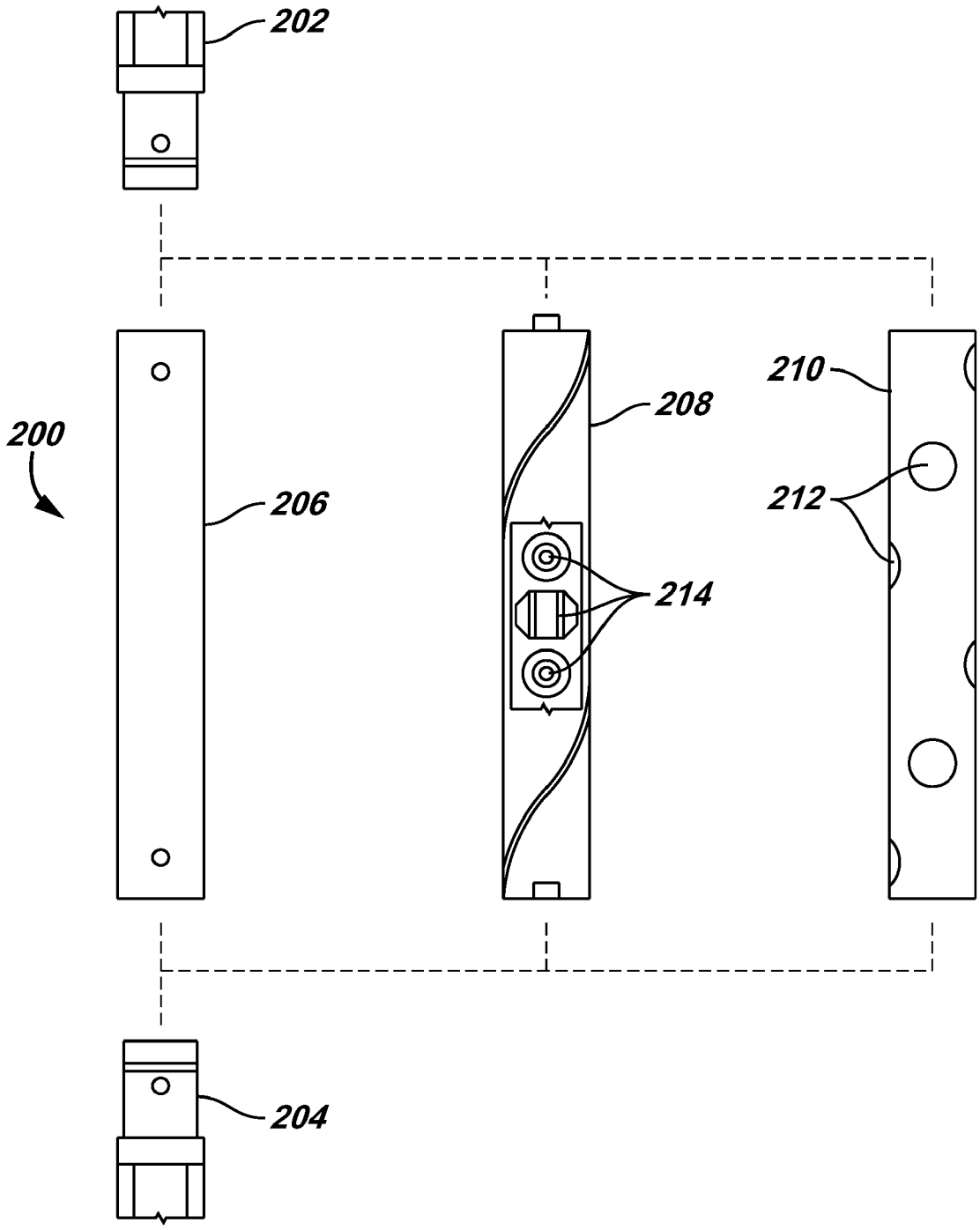
FIG. 2 is an exploded view of a portion of the tool string of FIG. 1.

Although the following describes some specific embodiments of components, the present invention can use other components and methods to achieve the desired result. FIG. 2 illustrates a component 200 that is usable with the tool string 100 depicted in FIG. 1. The component 200 can be any of a selected one of the component 106, 108, or 110 in the tool string 100 of FIG. 1. The component 200 includes an upper head assembly for attaching to another part of the tool string above the component 200, and a lower head assembly 204 for attaching the component 200 to a portion of the tool string below the component 200. Between the upper and lower head assemblies 202 and 204 is attached a carrier 206.

The carrier 206 is a hollow housing that is capable of receiving either a propellant loading tube 208 or a standard loading tube 210. The standard loading tube 210 is capable of carrying shaped charges that are mounted at positions corresponding to openings 212 in the loading tube 210. When activated, the shaped charges cause perforating jets to fire through respective openings 212. In the illustrated embodiment, the loading tube 210 has a generally cylindrical shape. In other embodiments, the loading tube 210 can have other shapes, including non-cylindrical shapes.

The propellant loading tube 208 is a propellant pre-cast to a cylindrical shape (according to one example implementation) or another shape. The propellant has cavities for receiving shaped charges 214. Thus, in effect, the propellant is a loading tube that has cavities for carrying shaped charges 214. In such an arrangement, the loading tube is formed of the propellant instead of more conventional metal housings. If the propellant loading tube 208 is provided in the carrier 206, then firing of the shaped charges 214 also causes activation of the propellant. Burning of the propellant causes high pressure gas to build up.

In operation, a detonating cord (or other type of detonator) is ballistically coupled to the shaped charges 214 of the propellant loading tube 208. The detonating cord or other detonator is also ballistically coupled to the propellant. A firing head causes initiation of the detonating cord (or other detonator) which in turn causes initiation of the propellant and the shaped charges 214. The shaped charges 214, once fired, shoots out perforating jets that blast corresponding holes through the carrier 206. The perforating jets extend through any casing or liner that lines the wellbore 102, and further extends perforations into the surrounding formation 112. At this time, after firing of the shaped charges 214, the propellant continues to burn, which causes buildup of high pressure gas in the wellbore interval. The buildup of high pressure gas causes an overbalance condition to be created in the wellbore interval.

The burning of the propellant can cause pressure to increase to a sufficiently high level to fracture the formation. The fracturing allows for better communication of reservoir fluids from the formation into the wellbore or the injection of fluids into the surrounding formation.

In an alternative embodiment, instead of shaped charges 214 that can extend perforating jets through surrounding casing/liner and formation, smaller shaped charges can be used that have sufficient energy to blow holes through the carrier 206 (but does not cause the perforation of the surrounding casing/liner in formation). In this case, perforations are not created in the formation 112—instead, openings are created in the carrier 206 to enable burning of the propellant to cause buildup of pressure to achieve an overbalance condition. In this alternative embodiment, the shaped charges are referred to as "punchers" or "puncher charges" since the charges are able to punch through the carrier 206 without cutting through the surround liner or casing.

Shaped charges in the standard loading tube 210 are similarly activated by a detonating cord or other detonator to cause generation of perforating jets that extend through the openings 212 of the loading tube 210. The perforating jets also create openings in the carrier 206. The difference is that a propellant is not burned in the standard loading tube 210 so that buildup of gas pressure does not occur with the activation of the shaped charges in the loading tube 210.

Figure 3:
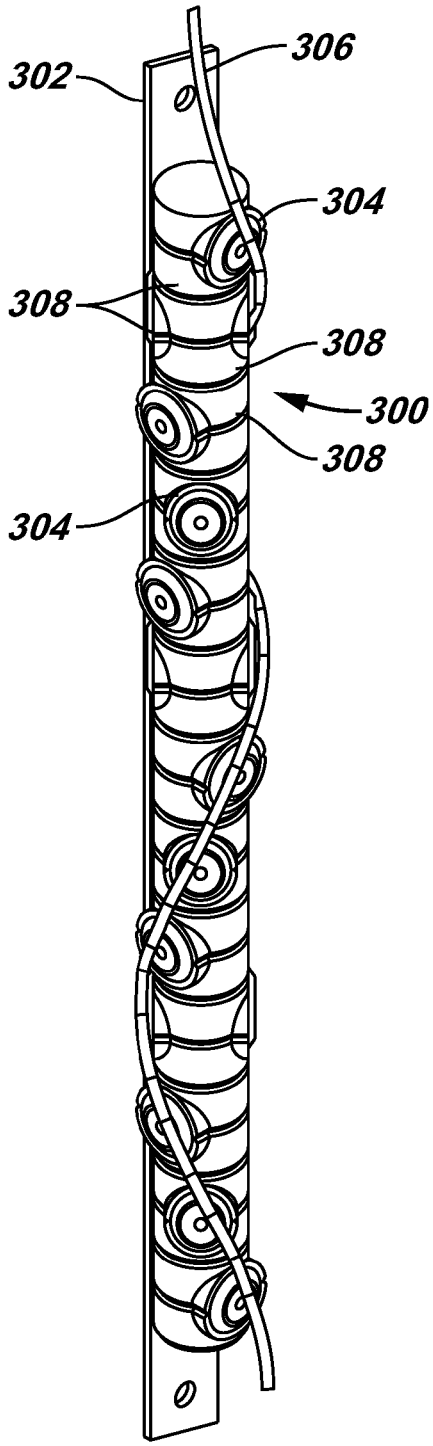
FIG. 3 illustrates a perforating gun according to an embodiment of the invention.

FIG. 3 illustrates a different arrangement of a perforating gun 300, which can be used as perforating gun 110 in FIG. 1. The perforating gun 300 includes a carrier strip 302 on which are mounted shaped charges 304. As depicted, the shaped charges 304 are arranged in a spiral pattern. A detonating cord 306 extends along the length of the perforating gun 300 in a generally spiral path to enable the detonating cord 306 to be ballistically connected to each of the shaped charges 304.

In the embodiment of FIG. 3, the shaped charges 304 are capsule shaped charges, which include sealed capsules for housing a shaped charge within each sealed capsule. The capsule shaped charges 304 do not have to be carried within a sealed gun carrier housing (such as carrier 206 in FIG. 2), but rather, the capsule shaped charges can be exposed to wellbore fluids.

In addition, propellant elements 308 in the form of inserts are provided in spaces available between capsule shaped charges 304 and around capsule charges 304. The propellant elements 308 are initiated in response to a detonation wave traveling through the detonating cord 306. Here again, activation of the shaped charges 304 also causes activation of the propellant inserts 308 to cause buildup of high pressure gas and creation of an overbalance condition in the wellbore interval.

Figure 4:
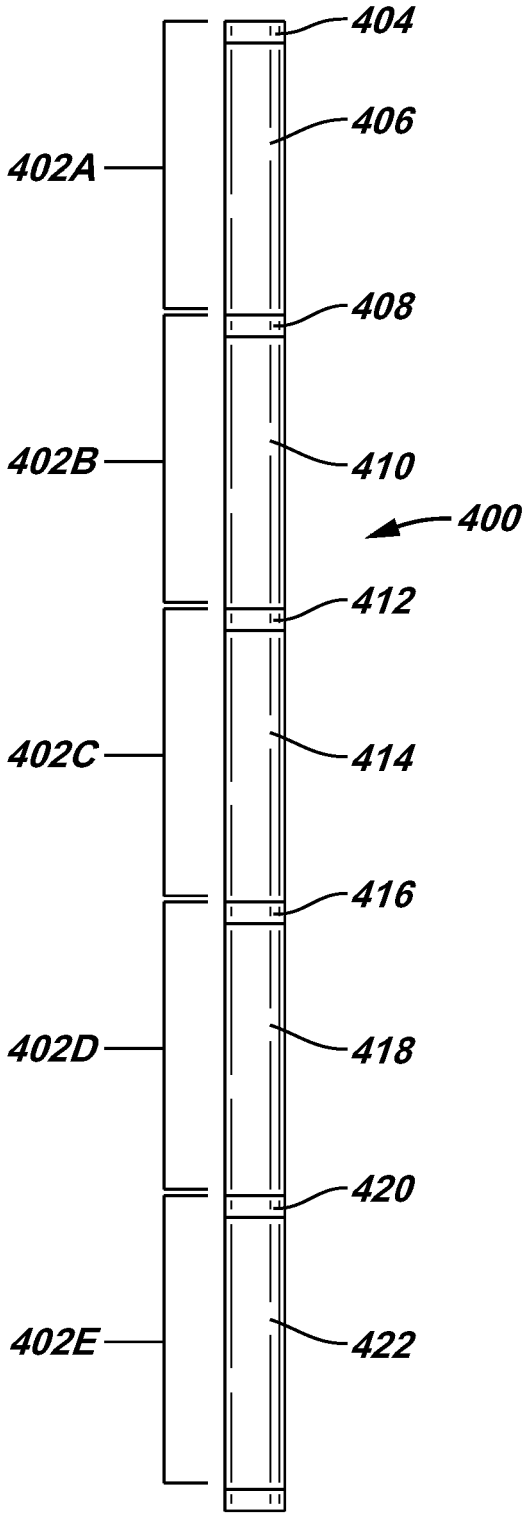
FIG. 4 illustrates a tool according to another embodiment of the invention.

FIG. 4 illustrates a tool string according to another embodiment of the invention. The tool string 400 of FIG. 4 includes several sections 402A, 402B, 402C, 402D, and 402E. The section 402A includes a control module 404, and a gun and propellant module 406. The gun and propellant module 406 includes both shaped charges and propellant elements. For example, the gun and propellant module 406 can either be the perforating gun 300 of FIG. 3 or the propellant loading tube 208 installed in the carrier 206 of FIG. 2.

The second section 402B includes a control module 408 and a perforating gun 410. In the second section 402B, a propellant is not provided. However, the perforating gun 410 can be designed to have a relatively large amount of empty space within the perforating gun 410. The empty space (space other than the shaped charges, the main core, and other components of the perforating gun 410) is initially sealed from the wellbore pressure. Upon firing of the shaped charges, openings are formed in the sealed housing of the perforating gun 410. Following shaped charge detonation, hot detonation gas fills the internal chamber of the gun 410. If the resultant detonation gas pressure is less than the wellbore pressure, then the cooler wellbore fluids are drawn into the gun housing. The rapid acceleration through perforation openings in the gun housing breaks the fluid up into droplets and results in rapid cooling of the gas. Hence, rapid loss of pressure in the gun that results in rapid wellbore fluid drainage causes a drop in the wellbore pressure. The drop in wellbore pressure creates the underbalance condition in the desired wellbore interval.

The next section 402C in the tool string 400 includes a control module 412 and a gun and propellant module 414. The gun and propellant module 414 can be similar to the gun and propellant module 406 (containing shaped charges that can extend perforations into surrounding formation) or the gun and propellant module 414 can include smaller shaped charges that are designed to blow openings through the housing of the module 414 but do not have sufficient energy to extend perforations into surrounding formation.

The next section 402D of the tool string 400 includes a control module 416 and a gun module 418. The gun module 418 can be similar to the gun module 410. The other section 402E includes a control module 420 and a gun and propellant module 422, which also includes both shaped charges and propellant elements. Note that sections 402A, 402C, and 402E when activated causes the creation of overbalance conditions in wellbore intervals proximal respective sections 402A, 402B, and 402C. Each of the sections 402B and 402D is able to cause creation of an underbalance conditions in wellbore intervals proximal the sections.

The order of the modules illustrated in FIG. 4 is provided for the purpose of example. In other implementations, other orders of the modules can be employed. Also, the order in which the modules are activated can also be controlled by the well operator. Activation of each section 402 is controlled by a respective control module. In some implementations, each of the control modules can include a timer that, when activated, causes a delay of some preset period before activation of the section.

Figure 5:
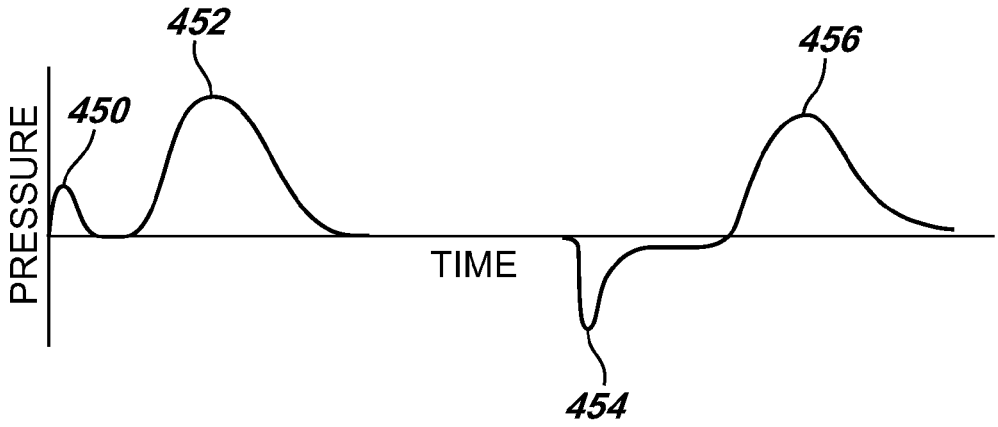
FIGS. 5-7 are timing diagrams to illustrate generation of transient underbalance and overbalance pressure conditions in a wellbore.

FIG. 5 is a timing diagram illustrating a sequence of transient pressure conditions generated by activation of different modules of a tool string (such as tool string 400 of FIG. 4 or tool string 100 of FIG. 1) in the wellbore interval.

According to FIG. 5, a perforating gun is first fired (which initially causes a relatively small transient overbalance condition 450 to be generated in the wellbore interval). The pressure then drops back to the normal pressure of the wellbore, which due to existence of the perforations in the surrounding formation is at the formation pressure.

Next, if a propellant has been initiated, then a larger overbalance condition 452 (having higher pressure than overbalance condition 450) is generated. After burning of the propellant, the pressure drops back down to the normal wellbore pressure. Next, a perforating gun that includes a module for creating a transient underbalance condition is activated, which causes a transient underbalance condition 454 to be generated. The module can be a hollow carrier that contains low pressure gas that when opened (such as by firing of shaped charges) causes surrounding pressure to drop (as discussed above). After activation of this module, the wellbore pressure returns to close to the normal wellbore pressure. Next, in response to initiation of another propellant, a transient overbalance condition 456 is created in the wellbore interval. Thus, in FIG. 5, the sequence of overbalance and underbalance conditions is as follows: first overbalance, second overbalance, underbalance, and third overbalance.

Figure 6:
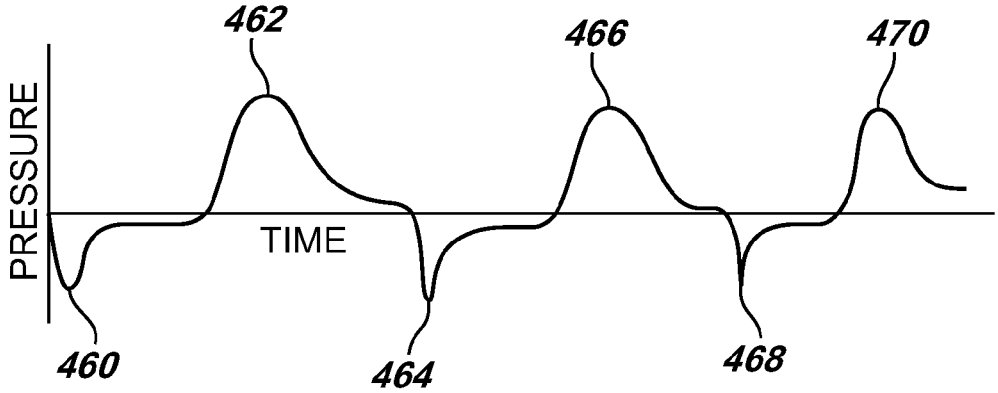

FIG. 6 shows another sequence of overbalance and underbalance conditions. After the first initiation of a perforating gun that is associated with an underbalance pressure creating module, a transient underbalance condition 460 is created. Next, after the wellbore interval has returned to the normal wellbore pressure, a propellant is activated to create an overbalance condition 462. Subsequently, additional underbalance conditions 464 and 468 and overbalance conditions 466 and 470 are created.

Figure 7:
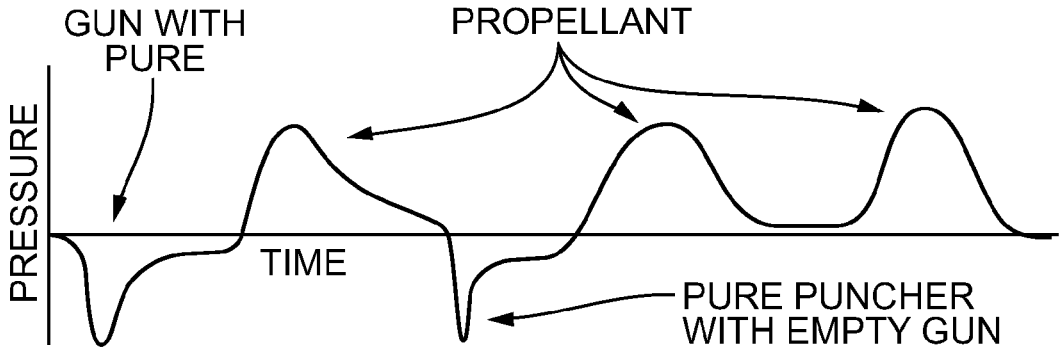

FIG. 7 shows yet another sequence of underbalance conditions and overbalance conditions. Note that FIGS. 5-7 show some example sequences. Many other sequences of underbalance and overbalance conditions are possible.

The intervals among the various pressure conditions illustrated in FIGS. 5-7 can be on the order of milliseconds, seconds, or even minutes apart if timers are provided in tools according to some embodiments. If timers are not provided, then the intervals among the various pressure conditions in FIGS. 5-7 can be on the order of microseconds.

Figure 8:
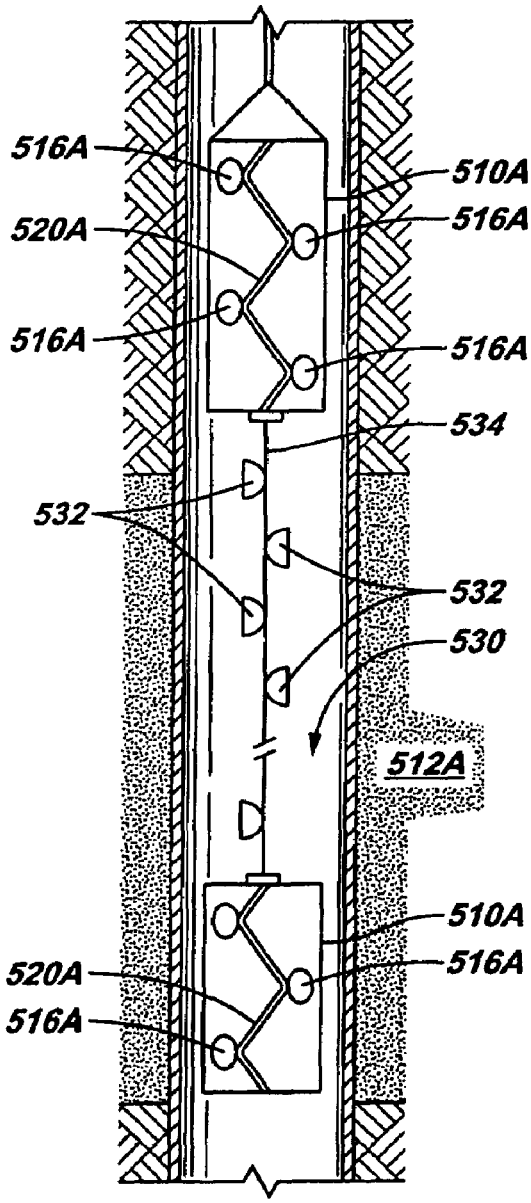
FIGS. 8 and 9 illustrate tools according to other embodiments for creating a transient underbalance condition.

FIG. 8 illustrates a tool for creating an underbalance condition, in accordance with an embodiment. Note that the tool of FIG. 8 can be used as part of the tool string illustrated in FIG. 1. The FIG. 8 tool includes an atmospheric container 510A used in conjunction with a perforating gun 530. In the embodiment of FIG. 8, the container 510A (which can be expendable in one implementation) is divided into two portions, a first portion above the perforating gun 530 and a second portion below the perforating gun 530. The container 510A contains a low-pressure gas (e.g., air, nitrogen, etc.) or other compressible fluid.

The container 510A includes various openings 516A that are adapted to be opened by an explosive force, such as an explosive force due to initiation of a detonating cord 520A or detonation of explosives connected to the detonating cord 520A. The detonating cord is also connected to shaped charges 532 in the perforating gun 530. In one embodiment, as illustrated, the perforating gun 530 can be a strip gun, in which capsule shaped charges are mounted on a carrier 534. Such a perforating gun 530 is also referred to as a capsule perforating gun. In alternative embodiments, the shaped charges 532 may be non-capsule shaped charges that are contained in a sealed container.

The openings 516A, in alternative embodiments, can include a valve or other element that can be opened to enable communication with the inside of the container 510A. Once opened, the openings 516A cause a fluid surge into the inner chamber of the atmospheric container 510A.

The fluid surge can be performed relatively soon after perforating. For example, the fluid surge can be performed within about one minute after perforating. In other embodiments, the pressure surge can be performed within (less than or equal to) about 10 seconds, one second, or 100 milliseconds, or 10 milliseconds, as examples, after perforating. The timing delay can be set by use of a timer in the tool.

Figure 9:
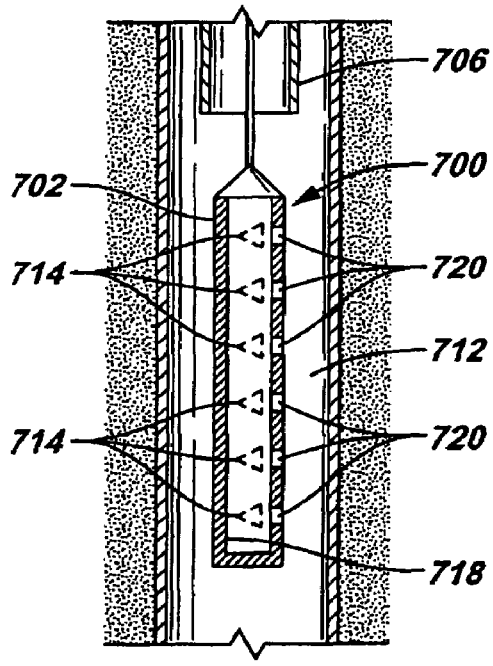

Referring to FIG. 9, yet another embodiment for creating an underbalance condition during a perforating operation is illustrated. A perforating gun 700 includes a gun housing 702 and a carrier line 704, which can be a slickline, a wireline, or coiled tubing. In one embodiment, the perforating gun 700 is a hollow carrier gun having shaped charges 714 inside a chamber 718 of a sealed housing 716. In the arrangement of FIG. 9, the perforating gun 702 is lowered through a tubing 706. A packer (not shown) can be provided around the tubing 706 to isolate an interval 712 in which the perforating gun 700 is to be shot (referred to as the "perforating interval 712"). A pressure $P_W$ is present in the perforating interval 712.

During detonation of the shaped charges 714, perforating ports 720 are formed in the housing 702 as a result of perforating jets produced by the shaped charges 714. During detonation of the shaped charges 714, hot gas fills the internal chamber 718 of the gun 716. If the resultant detonation gas pressure, $P_G$, is less than the wellbore pressure, $P_W$, by a given amount, then the cooler wellbore fluids will be drawn into the chamber 718 of the gun 702. The rapid acceleration of well fluids through the perforation ports 720 will break the fluid up into droplets, which results in rapid cooling of the gas within the chamber 718. The resultant rapid gun pressure loss and even more rapid wellbore fluid drainage into the chamber 718 causes the wellbore pressure $P_W$ to be reduced. Depending on the absolute pressures, this pressure drop can be sufficient to generate a relatively large underbalance condition (e.g., greater than 2000 psi), even in a well that starts with a substantial overbalance (e.g., about 500 psi). The underbalance condition is dependent upon the level of the detonation gas pressure $P_G$, as compared to the wellbore pressure, $P_W$.

When a perforating gun is fired, the detonation gas is substantially hotter than the wellbore fluid. If cold wellbore fluids that are drawn into the gun produce rapid cooling of the hot gas, then the gas volume will shrink relatively rapidly, which reduces the pressure to encourage even more wellbore fluids to be drawn into the gun. The gas cooling can occur over a period of a few milliseconds, in one example. Draining wellbore liquids (which have small compressibility) out of the perforating interval 712 can drop the wellbore pressure, $P_W$, by a relatively large amount (several thousands of psi).

In accordance with some embodiments, various parameters are controlled to achieve the desired difference in values between the two pressures $P_W$ and $P_G$. For example, the level of the detonation gas pressure, $P_G$, can be adjusted by the explosive loading or by adjusting the volume of the chamber 718 or adjusting the area of opening(s) into the chamber 718. The level of wellbore pressure, $P_W$, can be adjusted by pumping up the entire well or an isolated section of the well, or by dynamically increasing the wellbore pressure on a local level.

Figure 10:
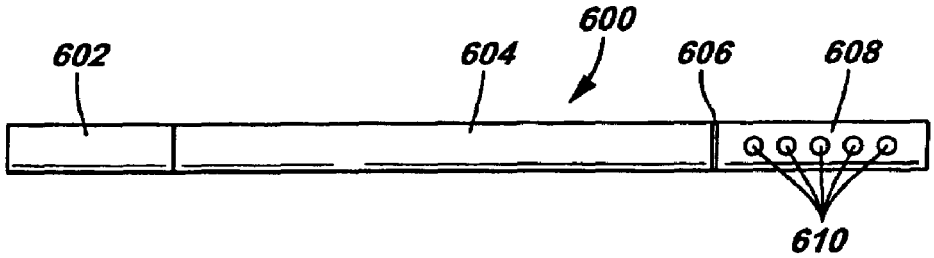
FIG. 10 illustrates a tool for generating a controlled, transient overbalance condition, according to an embodiment.

FIG. 10 illustrates an embodiment of a tool 600 (useable in the tool string of FIG. 1) that can be used to generate an overbalance pressure condition for the purpose of stimulating a wellbore interval. The tool 600 includes a propellant 602 and a pressure chamber 604. The pressure chamber 604 is used to collect gas byproducts created by initiation of the propellant 602. The tool 600 further includes a rupture element 606 (e.g., rupture disk) at one end of the pressure chamber 604. The tool 600 also incudes a vent sub 608 attached to the pressure chamber 604. The vent sub 608 includes multiple openings 610.

In operation, upon initiation of the propellant 602, high-pressure gas is collected in the pressure chamber 604. When the pressure in the pressure chamber 604 reaches a sufficiently high level, the rupture element 606 is ruptured. Upon rupture of the rupture element 606, the gas pressure in the pressure chamber 604 is released through the openings 610 of the vent sub 608.

The rupture element 606 is designed to rupture at a predetermined pressure, such as when ½, ¾, or some other fraction of the propellant 602 is consumed. The rupture pressure can be varied by changing the number of rupture disks used in the rupture element 606. By employing the tool 600 according to some embodiments, the pressure pulse that is applied to the surrounding formation can be controlled. This control can also be achieved by varying the volume of the pressure chamber 604, and/or by varying the area of the openings 610 in the vent sub 608. A reservoir of high-pressure gas is thus provided by the pressure chamber 604 and released in a controlled manner to the surrounding formation through the vent sub 608. In this manner, by controlling the release of high-pressure gas, damage to the surrounding formation due to unpredictable high pressure applied against the formation.

While the invention has been disclosed with respect to a limited number of embodiments, those skilled in the art will appreciate numerous modifications and variations therefrom. It is intended that the appended claims cover such modifications and variations as fall within the true spirit and scope of the invention.

The invention claimed is:

1. A method for use in a wellbore, comprising:

running a tool string to an interval of the wellbore;

activating a first component in the tool string to create a transient underbalance pressure condition in the wellbore interval; and after activating the first component to create the underbalance pressure condition, activating a second component in the tool string to create a transient overbalance pressure condition in the wellbore interval;

wherein activating the second component comprises initiating a propellant in the second component.

2. The method of claim 1, wherein initiating the propellant in the second component comprises initiating the propellant in conjunction with firing explosive devices in the second component.

3. The method of claim 2, wherein firing the explosive devices comprises firing shaped charges.

4. The method of claim 3, wherein the second component comprises a carrier housing containing the propellant and the shaped charges, the method further comprising punching openings in the carrier housing in response to firing the shaped charges.

5. The method of claim 1, wherein activating the second component occurs while the transient underbalance pressure condition is still present.

6. The method of claim 1, further comprising providing an interval of microseconds between the transient underbalance and overbalance pressure conditions.

7. A method for use in a wellbore, comprising:

running a tool string to an interval of the wellbore;

activating a first component in the tool string to create a transient underbalance pressure condition in the wellbore interval; and activating a second component in the tool string to create a transient overbalance pressure condition in the wellbore interval, wherein the first component comprises a housing in which at least one explosive is provided, wherein activating the first component comprises activating the at least one explosive in the housing to create openings in the housing to expose a chamber inside the housing to wellbore fluids for creating the transient underbalance pressure condition.

8. The method of claim 7, wherein activating the at least one explosive comprises activating a detonating cord.

9. The method of claim 8, further comprising providing a capsule perforating gun activatable by the detonating cord, the capsule perforating gun connected to the housing.

10. A method for use in a wellbore, comprising:

running a tool string to an interval of the wellbore;

activating a first component in the tool string to create a transient underbalance pressure condition in the wellbore interval;

activating a second component in the tool string to create a transient overbalance pressure condition in the wellbore interval; and providing, using a timer, an interval of one of milliseconds, seconds, and minutes between the transient underbalance and overbalance pressure conditions.

11. A method for use in a wellbore, comprising:

running a tool string to an interval of the wellbore;

activating a first component in the tool string to create a transient overbalance pressure condition in the wellbore interval; and after activating the first component, activating a second component in the tool string to create a transient underbalance pressure condition in the wellbore interval, wherein the second component comprises a housing in which at least one explosive is provided, wherein activating the second component comprises activating the at least one explosive in the housing to create openings in the housing to expose a chamber inside the housing to wellbore fluids for creating the transient underbalance pressure condition.

12. The method of claim 11, wherein activating the second component occurs while the overbalance condition is still present.

* * * * *